US006173511B1

(12) United States Patent
Perrault

(10) Patent No.: US 6,173,511 B1
(45) Date of Patent: Jan. 16, 2001

(54) ORTHOSIS FOR FOOTWEAR WITH POSITIONAL SELF-ADJUSTMENT

(76) Inventor: Ronald Perrault, 3 des Sapins Avenue, Notre-Dame-des Prairies, Quebec (CA), J6E 1C3

( * ) Notice: Under 35 U.S.C. 154(b), the term of this patent shall be extended for 0 days.

(21) Appl. No.: 09/307,706

(22) Filed: May 10, 1999

Related U.S. Application Data

(63) Continuation-in-part of application No. 09/091,751, filed as application No. PCT/CA96/00635 on Sep. 23, 1996, now abandoned, which is a continuation of application No. 08/578,288, filed on Dec. 26, 1995, now abandoned.

(51) Int. Cl.[7] ..... A43B 7/16; A61F 5/14

(52) U.S. Cl. ..... 36/140; 36/92; 36/173; 36/174

(58) Field of Search ..... 36/91, 88, 43, 36/140, 173, 174, 182, 176, 180, 92

(56) References Cited

U.S. PATENT DOCUMENTS

| | | | | |
|---|---|---|---|---|
| 892,652 | * | 7/1908 | Dahlmann . | |
| 1,974,161 | | 9/1934 | Riley . | |
| 1,995,506 | * | 3/1935 | Guy . | |
| 2,255,100 | | 9/1941 | Brady . | |
| 2,335,187 | * | 11/1943 | Keil | 36/173 |
| 2,355,168 | * | 8/1944 | Kubovcik . | |
| 2,498,624 | | 2/1950 | Skinner . | |
| 3,081,774 | * | 3/1963 | Lelyveld | 36/174 |
| 4,216,778 | | 8/1980 | Weis . | |
| 4,686,993 | | 8/1987 | Grumbine . | |
| 4,689,898 | * | 9/1987 | Fahey | 36/43 |
| 4,759,357 | | 7/1988 | Allart et al. . | |
| 5,069,212 | | 12/1991 | Cohen . | |
| 5,174,052 | | 12/1992 | Schoenhaus et al. . | |
| 6,038,793 | * | 3/2000 | Kendall | 36/173 |

FOREIGN PATENT DOCUMENTS

| | | | | |
|---|---|---|---|---|
| 456290 | * | 11/1936 | (AU) . | |
| 1127676 | * | 12/1956 | (FR) | 36/176 |
| 569553 | * | 5/1945 | (GB) | 36/176 |

* cited by examiner

*Primary Examiner*—M. D. Patterson
(74) *Attorney, Agent, or Firm*—François Martineau

(57) ABSTRACT

The orthosis is formed of a monolithic semi-rigid resilient shell and is engaged inside a footwear to conformingly fit against the plantar portion of a person's foot, extending from the anterior metatarsal region to the heel portion. The rear end portion of the orthosis has inner and outer rearwardly-extending resiliently deformable arms defining a rearwardly-opened notch therebetween for partial engagement of the heel in the notch. Upwardly arcuate inner and outer flanges are provided respectively on the inner and outer arms, opposite the notch, for forming a cup-like seat for the heel. The front end portion of the orthosis engages the metatarsal plantar region of the foot, and has a sinuous front edge having five frontwardly-facing arcuate concavities each for registering engagement thereagainst of a corresponding one of the five metatarsal anterior portions of the user's foot. The combination of the independently deformable arms forming a cup-like seat with the front edge concavities allow stabilization and positional self-adjustment of the orthosis inside the footwear, to compensate accidental positional shifts of the orthosis in the footwear.

6 Claims, 6 Drawing Sheets

ORTHOSIS FOR FOOTWEAR WITH POSITIONAL SELF-ADJUSTMENT

CROSS-REFERENCE DATA

This is a Continuation-In-Part application of U.S. patent application Ser. No. 09/091,751 filed Jun. 24, 1998, now abandoned, the latter being a national stage application of international application No. PCT/CA96/00635 filed Sep. 23, 1996, which is a Continuation application of U.S. patent application Ser. No. 08/578,288 filed on Dec. 26, 1995, now abandoned.

FIELD OF THE INVENTION

The present invention relates to shoe inserts used by podiatrists in correcting a medical condition deficiency in the foot.

BACKGROUND OF THE INVENTION

Footwear insoles, also called podiatric orthoses or orthotic shoe inserts, are used to support the human foot in a footwear, and have been known for quite some time in the field. These devices consist usually of a moulded blank shell formed monolithically from a resilient semi-rigid sheet material, usually a synthetic plastic material. Orthotics are characterized by the fact that they properly adjust the orientation of a handicapped person's foot during gait, for controlling its motion in view of mitigating the adverse effects of podiatric anomalies. Examples of such insoles include U.S. Pat. No. 4,756,096 issued Jul. 12, 1988 to Grant Meyer, and U.S. Pat. No. 4,338,734 issued Jul. 13, 1982 to Apex Foot Products Corp.

Some of these orthoses do not form full plantar shells. For instance, U.S. Pat. No. 5,058,585 issued Oct. 22, 1991 to Michael Kendall discloses a generally open orthotic shoe insert forming a curved wedge having a generally open hook-like shape. This insert is said to control foot motion during gait, and includes a heel portion, adapted to engage the sides of the heel, a middle portion, adapted to engage the plantar side of the medial portion of the foot longitudinal arch, and a front portion adapted to engage the plantar side of the user's forefoot to a level just distal to the first and second metatarsal heads. Such an orthosis is claimed to be self-adjusting.

U.S. Pat. No. 5,174,052 issued Dec. 29, 1992 to Harold Schoenhaus and Richard Jay, discloses an orthotic device having a deep heel seat to cup the calcaneus. High medial and lateral flanges define a bottom forwardly opening notch. This orthotic device is designed to prevent hyperpronation of the human foot.

Problems with these known orthotic devices include:

(a) they take too much volume in the footwear, so the foot is uncomfortably compressed inside the footwear;

(b) they often are undesirably allowed to accidentally shift in position inside the footwear, especially during prolonged gait.

The Schoenhaus patent is a good example of an orthosis which takes too much volume. The rear portion of this U-shaped orthosis will effectively require space under and around the heel portion of the foot, since the heel rests on the orthosis and the orthosis moreover partially surrounds the heel. The person wearing a shoe in which is provided the Schoenhaus orthosis is likely to be less comfortable in the shoe, since the foot will be raised in the shoe by the orthosis; considering that shoes are not designed for feet having a thickness which is abnormally increased relative to the usual proportional dimension of the feet, the wearer of the shoes fitted with the Schoenhaus orthoses is likely to be uncomfortable.

Another problem with the Schoenhaus orthosis is that the frontwardly-opened notch in the orthosis main body may effectively allow the foot to tilt, pivot and rotate around the heel portion, due to the flexibility conferred to the orthosis by the frontwardly-opened notch. Indeed, rotation and pivotal movement of the foot is achieved at the ankle, located substantially over the heel portion of the foot. Allowing the two frontwardly extending arm portions of the orthosis to laterally flex under load, effectively counteracts the results which are desired by wearing an orthosis, which is to prevent undesirable positions of the foot, some positional deficiencies being achieved under accidental tilting, rotating or pivotal movements of the foot which may be allowed by the flexibility of the frontwardly extending arms of the Schoenhaus orthosis.

Yet another disadvantage of the Schoenhaus patent is that weaker support under the foot arch is provided, since the opened notch is located under the foot arch.

U.S. Pat. No. 4,686,993 issued in 1987 to Grumbine shows an orthosis which has an arch support portion and a rear slightly concave heel seat which has a central opening in which the heel is partially engageable. The rear opening allows a lesser overall thickness of the orthosis rear portion, but the support offered by the Grumbine orthosis is not sufficient, especially due to a lack of lateral support.

As with most prior art orthoses, both the orthoses disclosed in the Grumbine and the Schoenhaus patents also have the important disadvantage of being allowed to accidentally move or shift inside the shoe, especially during prolonged gait, since no means are provided for positional self-adjustment of the orthosis inside the shoe. Thus, under repetitive or sudden foot movement inside the shoe, the orthosis may be allowed to shift inside the shoe, which of course results in undesirable discomfort for the wearer.

U.S. Pat. No. 1,974,161 issued in 1932 to Riley and U.S. Pat. No. 2,498,624 issued in 1948 to Skinner both disclose orthoses having a rear heel notch, which allows the rear portion of the shoe insole to take up less volume in the rear portion of the footwear. However, no lateral support whatsoever is provided by the Riley and Skinner orthoses at the rear portion of the foot, and thus no accidental insole shifting or foot hyperpronation is prevented with these insoles.

A problem associated with most orthoses is that lesions are often created on the front plantar portion, under the metatarsal heads or rearwardly near them, by the front edge of the orthosis or of the insole. Indeed, the orthoses or insoles often extend short of the toes, as shown in the Grumbine, Skinner, Riley and Schoenhaus patents. Although the orthosis is expected to gradually frontwardly slope towards the shoe's sole so as to form therewith an almost continuous surface under the metatarsal head region, the reality is otherwise: the frontmost edge of the orthosis often repetitively raises during gait spacedly above the shoe's sole, and under repetitive contact with the foot plantar surface, is likely to cause lesions and injure the foot plantar metatarsal region. Moreover, the foot is often not allowed to recover from these lesions, since the already injured plantar foot portion continues to suffer lesions from its subtle contact with the linear front edge portion of the orthosis under continued use of the orthosis.

OBJECTS OF THE INVENTION

An important object of the invention is to provide an orthosis that will take up very small volume inside the footwear, yet will provide good foot standing stability during gait.

A further object of the invention is that the heel itself will stabilize the orthosis in position during gait, against accidental shifts in position thereof inside the footwear.

Yet another object of the present invention is to provide an orthosis configured to allow the anterior metatarsal plantar region to stabilize and adjust the position of the orthosis during gait, against accidental shifts of the orthosis inside the footwear.

An object of the invention is that the orthosis help prevent foot lesions, especially at the metatarsal plantar region.

SUMMARY OF THE INVENTION

The present invention relates to shoe inserts used by podiatrists in correcting a medical condition deficiency in the foot.

More particularly, the present invention relates to an orthosis for engagement inside a footwear and for conformingly fitting against the plantar portion of a person's foot for compensating podiatric deficiencies, said orthosis being formed of a monolithic semi-rigid resilient shell defining inner and outer lateral sides and having:

an arched intermediate portion for complementary vertical resilient spring-back engagement against the foot arch plantar portion;

a rear end portion comprising spaced-apart inner and outer rearwardly-extending resiliently deformable arms for partial resting abutment of said heel onto said arms, said arms defining at their rear end portions a rearwardly-opened notch therebetween for enabling partial engagement of the heel in said notch, said inner and outer arms respectively forming upwardly arcuate inner and outer flanges opposite said notch, for complementary engagement partly around the heel portion of the foot;

a front end portion integrally frontwardly extending from said intermediate portion and for complementary engagement near the anterior metatarsal plantar region of the foot said front end portion having a sinuous front edge comprising a number of frontwardly-facing arcuate concavities each for registering engagement thereagainst by a corresponding one of the metatarsal anterior portions of that person's foot, allowing distinct metatarsal support and articulate positional self-adjustment of said orthosis inside the footwear in addition to helping to prevent plantar lesions;

wherein positional self-adjustment of the orthosis inside the footwear is further accomplished during gait by the load of the person being applied on his heel and against said orthosis arms, which are yieldingly resiliently moved apart and pressed against the shoe inner walls, and wherein said flanges form a cup-like heel seat to promote stabilization and positional self-adjustment of said orthosis and positive foot support while said, notch allows a thinner orthosis rear portion configuration.

The present invention further relates to an orthosis formed of a monolithic semi-rigid resilient shell for engagement inside a footwear and for conformingly fitting against the plantar portion of a person's foot, said orthosis adapted to extend from the anterior metatarsal region to the heel portion, said orthosis defining an inner and an outer side and comprising a rear end portion having inner and outer rearwardly-extending resiliently deformable arms defining at their rear ends a rearwardly-opened notch therebetween for partial engagement of the heel in said notch, said rear end portion further having upwardly arcuate inner and outer flanges integrally carried respectively on said inner and outer arms, opposite said notch, for forming a cup-like seat for the heel, said orthosis further comprising a front end portion for engaging the metatarsal plantar region of the foot, having a sinuous front edge which includes five of frontwardly-facing arcuate concavities each for registering wedging engagement therein by a corresponding one of the five metatarsal anterior portions of that person's foot;

wherein the combination of the independently deformable arms forming said cup-like heel seat with said front edge concavities forming metatarsal head seats, allows stabilization and positional self-adjustment of said orthosis inside the footwear to compensate accidental positional shifts of said orthosis in the footwear.

DETAILED DESCRIPTION OF THE INVENTION

Figure 1:
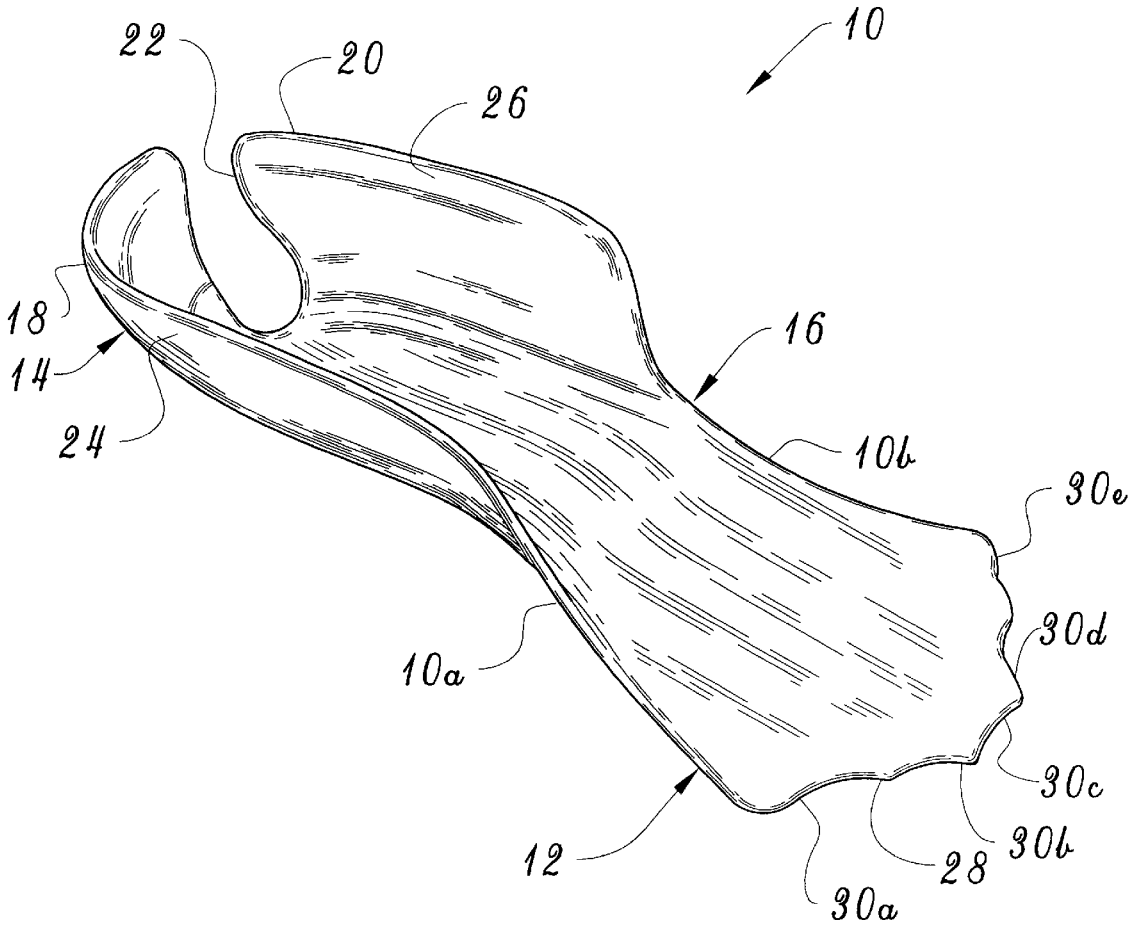
FIG. 1 is a perspective view of a left-foot orthosis according to the invention.
Figure 2:
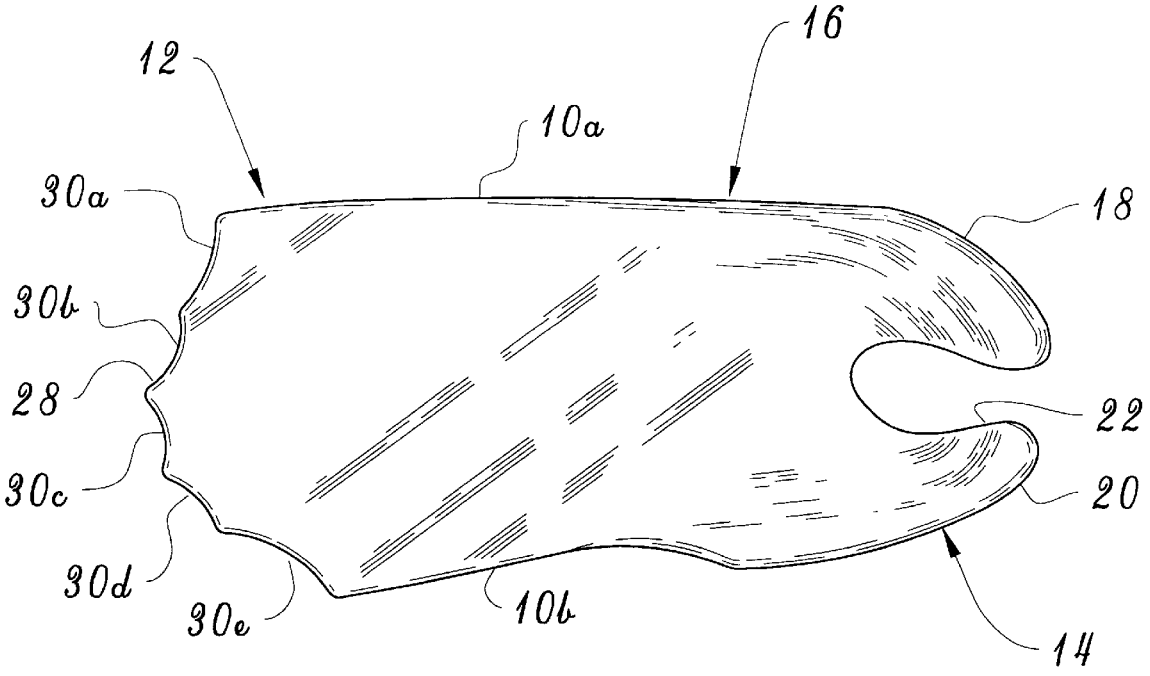
FIGS. 2 and 3 are respectively a top plan view and an outer side elevation of the orthosis of FIG. 1.
Figure 3:
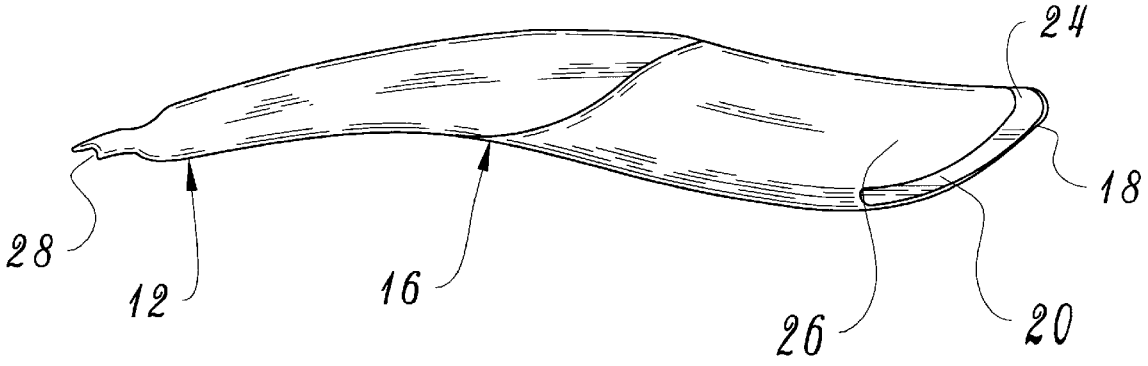
Figure 4:
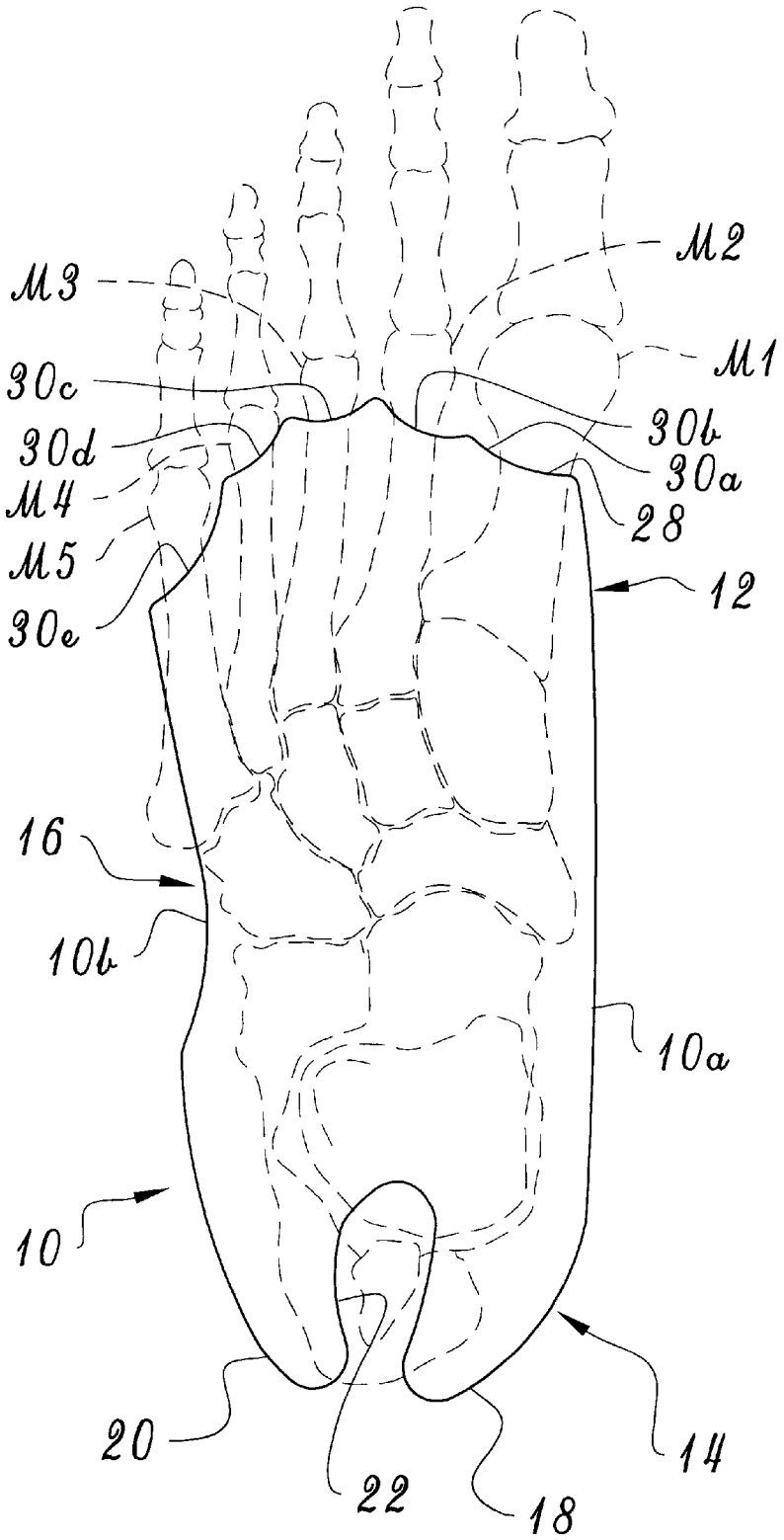
FIGS. 4 and 5 are bottom plan views of respectively a right-foot and a left-foot orthosis according to the invention, with FIG. 4 showing in dotted lines the bones of a left foot operatively overlying the left-foot orthosis according to the invention; and with FIG. 5 showing in dotted lines a right foot operatively overlying the right-foot orthosis; according to the invention.
Figure 5:
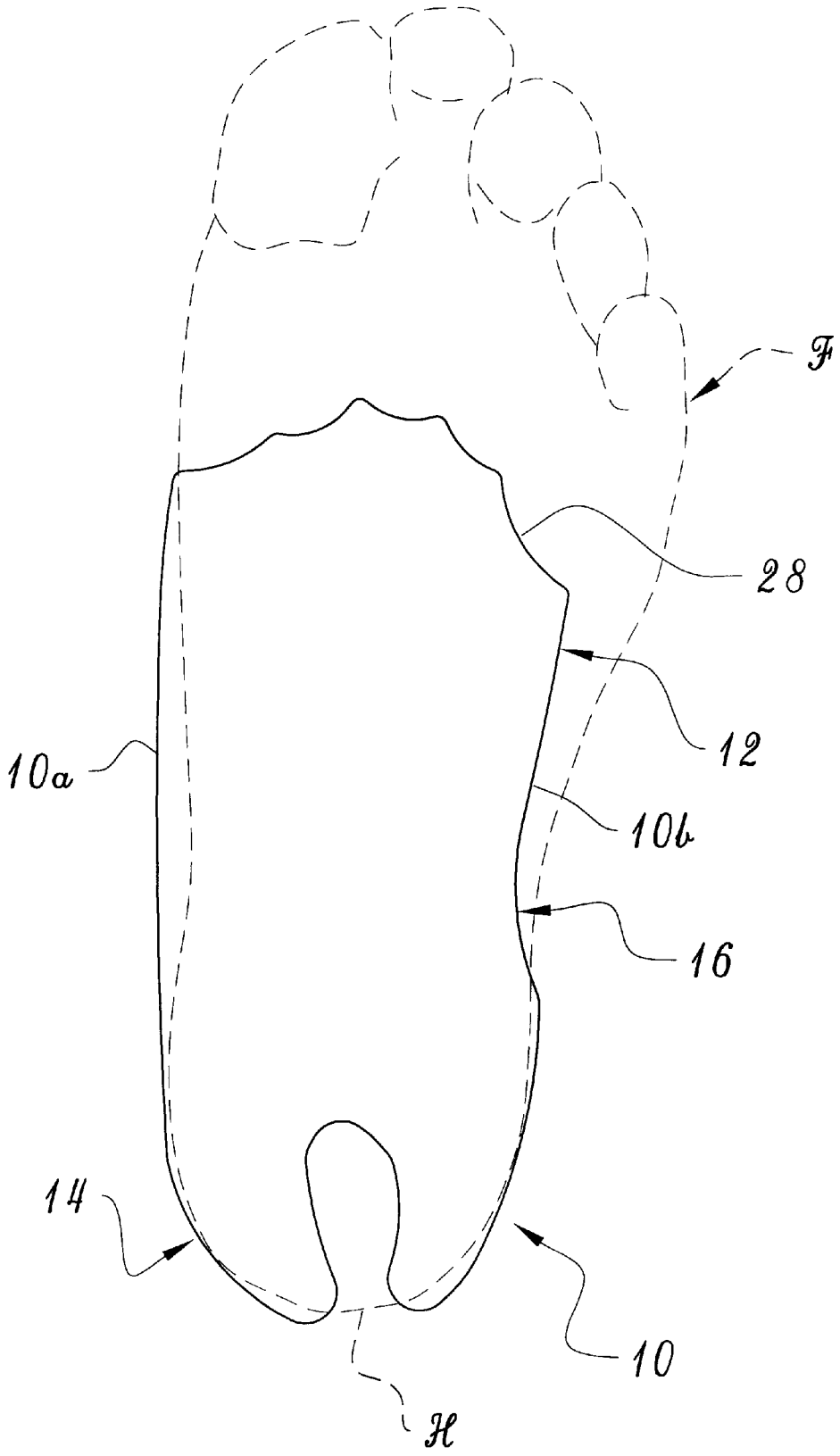
Figure 6:
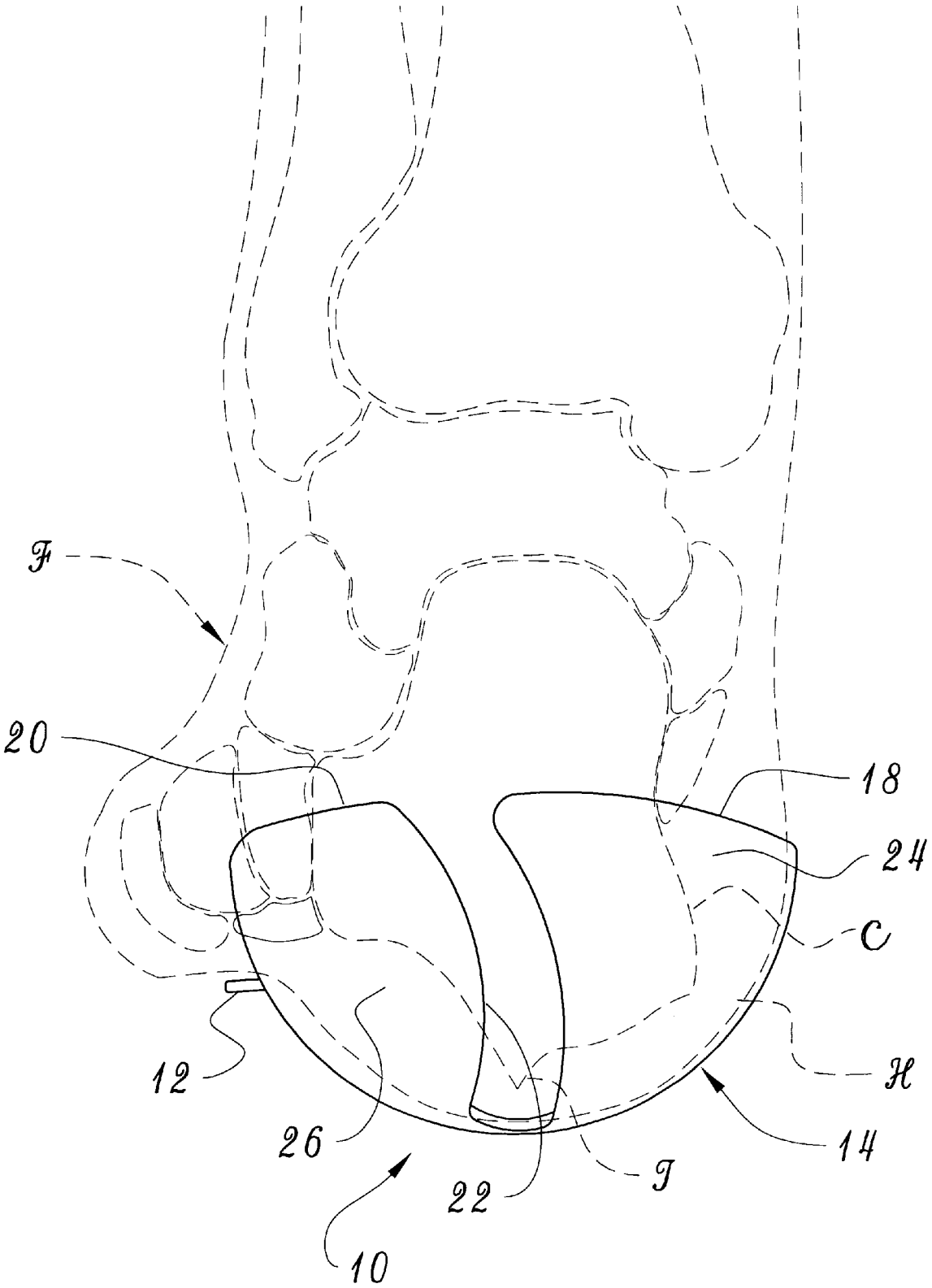
FIGS. 6 and 7 are respectively a rear view and an outer side elevation of the orthosis operatively underlying a left foot illustrated in dotted lines together with its bone formation.

FIGS. 1 to 3 show an orthosis 10 according to the invention, being formed of a monolithic semi-rigid resilient shell and defining inner and outer lateral sides 10*a,* 10*b,* a front end portion 12, a rear end portion 14, and an intermediate portion 16 therebetween. Orthosis 10 is to be inserted inside a footwear (not shown) in a conventional fashion, for conformingly fitting against the plantar portion of a person's foot (FIGS. 4 to 7). The orthosis 10, shown in FIGS. 1, 2, 3, 5, 6 and 7 is a left-foot orthosis, while the orthosis 10 shown in FIG. 4 is a right-foot orthosis; in any event, both left foot and right foot orthoses may or may not be exact mirror images of each other, depending on each foot pathological conformation, and are each asymmetrical so as to conformingly fit to the asymmetrical foot configuration. Each orthosis 10 is preferably custom-moulded to each foot, so as to precisely correspond to the feet of each individual. It is understood, for clarity of the present specification, that reference to the inner and outer lateral sides 10*a,* 10*b* of orthosis 10 will be made according to a person's feet, i.e. a person wearing a pair of orthoses 10, 10 will have their inner sides 10*a,* 10*a* facing each other, while their outer sides 10*b*, 10*b* will face outwardly in opposite directions. The inner side 10*a* of orthosis 10 has a generally convex shape and provides corrective support as known in the art, e.g. against hyperpronation; while the outer side 10*b* of orthosis 10 has a generally concave shape for occupying less volume inside the footwear and thus enhance comfort of the person wearing orthosis 10.

Figure 7:
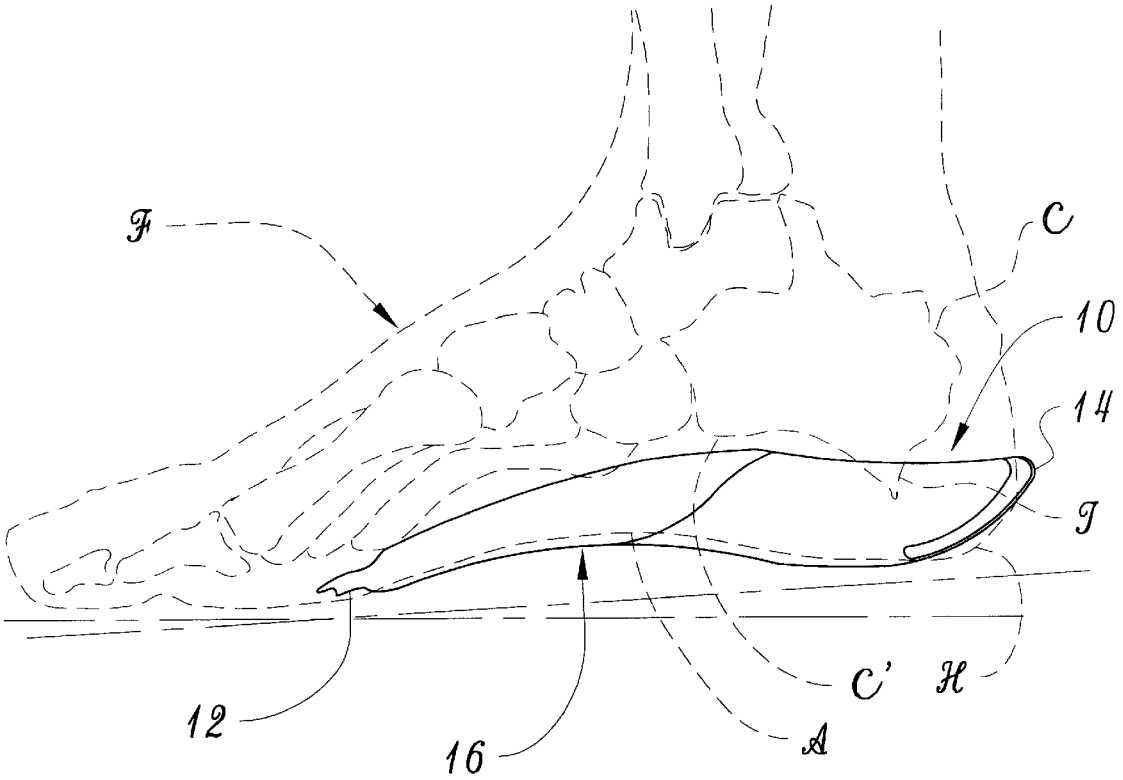

The intermediate portion 16 of orthosis 10 is arched for complementary vertical engagement against the foot plantar arch portion A (FIG. 7). Moreover, under the resiliency of orthosis 10 and due to the arched shape of intermediate portion 16, the latter will have a positive substantially vertical spring-back effect on the foot arch portion during gait, for promoting corrective foot positioning.

The orthosis rear end portion 14 comprises an inner and an outer rearwardly-extending resiliently deformable arms 18, 20 defining a rearwardly-opened generally ovoidal notch 22 therebetween. Upwardly arcuate flanges 24, 26 are formed at the periphery of the orthosis rear end portion 14, with inner and outer arms 18, 20 respectively carrying the rear part of inner and outer flanges 24, 26. Flanges 24, 26 diverge from notch 22 and are both curved frontwardly as they extend up to intermediate portion 16, along the orthosis sides 10*a*, 10*b*. Inner flange 24 gradually blends into the orthosis inner arched intermediate portion 10*a*, 16 to form a substantially continuous inner edge 10*a*, while outer flange 26 is cut away frontwardly of rear end portion 14 of orthosis 10. Rear end portion 14, with arcuate flanges 24, 26, thus forms a cup-like seat for a person's heel, as will be explained hereinafter. Open notch 22, extends between flanges 24, 26 in an upwardly and outwardly curved fashion.

Front end portion 12 integrally frontwardly extends from intermediate portion 16 and becomes wider to conform to the shape of the foot anterior metatarsal region. Front end portion 12 has a sinuous front edge 28 comprising alternating apexes and recesses, to form a number of frontwardly-facing arcuate concavities generally referred to with number 30, and more particularly five concavities 30*a*, 30*b*, 30*c*, 30*d* and 30*e* as shown in the drawings. Front edge 28 is generally frontwardly convex so as to conform to the forefoot configuration.

In use, as shown in FIGS. 4 to 7, orthosis 10 is to be positioned inside a footwear (not shown) against the plantar portion of the foot F, with the intermediate portion 16 conformingly engaging the underface of the foot arch A, as explained hereinabove. The orthosis rear portion 14 engages the foot heel portion H, with partial engagement of the heel inside notch 22 in register with the tuberosity T of the calcaneum C (FIG. 7). The anterior portion C' of the calcaneum overlies orthosis 10 frontwardly relative to notch 22. Flanges 24, 26 complementarily engage the heel portion H of the foot so as to partly surround heel H so as to form a cup-like seat for heel H.

Thus, positional self-adjustment of the orthosis is accomplished during gait by the load of the person being applied on his heel H and against the orthosis arms 18, 20, which are yieldingly resiliently moved apart and pressed against the footwear inner walls to correctly re-position orthosis 10 in the footwear if accidental temporary displacement of orthosis 10 occurred. Flanges 24, 26, in addition to promoting positional self-adjustment of orthosis 10 in the footwear, also provide positive foot support to enhance corrective foot positioning in the footwear.

The presence of notch 22 allows arms 18, 20 to be formed, with the abovementioned advantages. Moreover, notch 22 allows a thinner orthosis rear portion configuration, since heel H is effectively allowed to partly engage notch 22, and thus a thinner rear portion of orthosis 10 is located between heel H and the footwear sole inner wall. Consequently, orthosis 10 is less cumbersome inside the footwear, hence a greater comfort for the person wearing orthosis 10.

The front end portion 12 of orthosis 10 is located near and complementarily engages the anterior metatarsal plantar region of the foot F. More particularly, the orthosis front end portion extends just short of the metatarsal anterior portions or heads M1, M2, M3, M4, M5 (FIG. 4), with concavities 30 being positioned for registering engagement against a corresponding metatarsal anterior portion. As shown in the drawings, concavities 30*a*, 30*b*, 30*c*, 30*d* and 30*e* register respectively with the first, second, third, fourth and fifth metatarsal anterior portions M1, M2, M3, M4 and M5. This allows distinct support and articulate positional self-adjustment of orthosis 10 in the footwear, since any deviation of the orthosis inside the footwear will be corrected by the load-bearing seating abutment of the metatarsal anterior portions generally referred as M against their respective concave orthosis recesses 30. Each metatarsal head M bearing against a concavity 30 will effectively forcibly slide against the concave surface thereof under load-bearing conditions to properly align orthosis 10, hence further positional self-adjustment of orthosis 10 in the footwear. Generally, orthosis 10 will be less likely to shift inside the footwear due to the five metatarsal heads M bearing against and being wedged in the corresponding number (5) of concavities 30 under the load of the person wearing orthosis 10 in his footwear.

Moreover, concavities 30 additionally help prevent plantar lesions that often occur under prolonged use of a footwear orthosis. Indeed, concavities 30 provide a configuration to the orthosis front end portion 12 which is more adapted to the pressure points of the foot F, i.e. that the metatarsal anterior portions M will effectively be conformingly seated against their respective concavities 30 during load-bearing conditions, such as at toe-off. Prior art orthoses often provided straight front edges, that undesirably could, at length, cause lesions to the registering foot plantar surface under load-bearing conditions due to the abutment of the metatarsal anterior portions onto the orthoses straight front edges. The presence of concavities 30 helps to prevent and obviate this problem.

It is alternately envisioned to provide a narrow central tongue frontwardly extending from the central portion of edge 28, this central tongue replacing the second and third concavities 30*b*, 30*c*. The purpose of the central tongue is to engage the plantar portion of the foot frontwardly of the second and third metatarsal heads M2, M3, if a plantar lesion has developed at this position (which is not an uncommon occurrence). The central tongue then acts to soothe and help resorption of the foot lesion. This, however, is not the preferred embodiment of the invention, since two of the five concavities 30 would then be absent.

The unexpected results and important advantages of the orthosis of the present invention over the prior art orthoses are brought about by its particular structural characteristics, namely:

a) The cup-like heel seat partly surrounds the heel H to concurrently support the foot while allowing positional self-adjustment of orthosis 10 inside the footwear. The rearwardly-opened notch 22 provided in the cup-like heel seat allows the positional self-adjustment to be accomplished by allowing movement of the orthosis relative to the foot, since the heel partly engages the notch and can thus partly rest on the inner footwear sole; and by allowing resilient deformation of the individual rearwardly-extending arms 18, 20 yieldingly under the load of the person, with arms 18, 20 being deformed against the footwear inner walls. The notch also greatly reduces the bulk of the orthosis at its rear end portion 14.

b) The front end portion 12 of orthosis 10 is provided with concavities 30 which simultaneously help prevent foot plantar lesions while promoting stabilization and positional self-adjustment of the orthosis inside the footwear due to the foot five metatarsals individually bearing against their corresponding edge concavity 30 during toe-off.

The synergistic combination of the heel-engaged notch 22 and the concavities 30 is particularly advantageous in circumventing the positional problem of the orthosis inside the footwear. Indeed, during a single step accomplished by the person wearing the orthosis, the load of this person will be transferred from the heel to the toes. In each of these two step stages, positional self-adjustment of the orthosis is accomplished by the load being applied alternately on the resilient arms 18, 20 and on the concavities 30, to allow continuous positional self-adjustment of the orthosis inside the footwear, and according to the particular foot configuration of the wearer. Considering that a misplaced orthosis can be both cumbersome and painful, the positional self-adjustment of an uncumbersome orthosis, such as the one provided by the present invention, is of utmost importance.

Any modifications to the present invention, which do not deviate from the scope thereof, are considered to be included therein.

I claim:

1. An orthosis for engagement inside a footwear and for conformingly fitting against the plantar portion of a person's foot for compensating podiatric deficiencies, said orthosis being formed of a monolithic semi-rigid resilient shell defining inner and outer lateral sides and having:

an arched intermediate portion for complementary vertical resilient spring-back engagement against the foot arch plantar portion;

a rear end portion comprising spaced-apart inner and outer rearwardly-extending resiliently deformable arms for partial resting abutment of said heel onto said arms, said arms defining at their rear end portions a rearwardly-opened notch therebetween for enabling partial engagement of the heel in said notch, said inner and outer arms respectively forming upwardly arcuate inner and outer flanges opposite said notch, for complementary engagement partly around the heel portion of the foot;

a front end portion integrally frontwardly extending from said intermediate portion and for complementary engagement near the anterior metatarsal plantar region of the foot, said front end portion having a sinuous front edge comprising a number of frontwardly-facing arcuate concavities each for registering engagement thereagainst by a corresponding one of the metatarsal anterior portions of that person's foot, allowing distinct metatarsal support and articulate positional self-adjustment of said orthosis inside the footwear in addition to helping to prevent plantar lesions;

wherein positional self-adjustment of the orthosis inside the footwear is further accomplished during gait by the load of the person being applied on his heel and against said orthosis arms, which are yieldingly resiliently moved apart and pressed against the shoe inner walls, and wherein said flanges form a laterally supporting heel seat to promote stabilization and positional self-adjustment of said orthosis and positive foot support while said notch allows a thinner orthosis rear portion configuration.

2. An orthosis as defined in claim 1, wherein said orthosis front portion comprises five concavities each registering with a corresponding one of the five metatarsal anterior portions of that person's foot.

3. An orthosis as defined in claim 1, wherein each of said inner and outer flanges extends from said notch to said orthosis intermediate portion.

4. An orthosis as defined in claim 1, wherein said orthosis outer side is generally concave.

5. An orthosis for engagement inside a footwear and for conformingly fitting against the plantar portion of a person's foot for compensating podiatric deficiencies, said orthosis being formed of a monolithic semi-rigid resilient shell defining inner and outer lateral sides and having:

an arched intermediate portion for complementary vertical resilient spring-back engagement against the foot arch plantar portion;

a rear end portion comprising inner and outer rearwardly-extending resiliently deformable arms spaced from one another for partial resting abutment of said heel onto said arms, said arms defining at their rear ends a rearwardly-opened notch therebetween for enabling partial engagement of the heel in said notch, said inner and outer arms respectively forming upwardly arcuate inner and outer flanges opposite said notch, said arms with said flanges forming a laterally-supporting seat for complementary engagement partly under and around the heel portion of the foot;

a front end portion integrally frontwardly extending from said intermediate portion and for complementary engagement near the anterior metatarsal plantar region of the foot;

wherein positional self-adjustment of the orthosis inside the footwear is accomplished during gait by the load of the person being applied on his heel and against said orthosis arms, which are yieldingly resiliently moved apart and pressed against the shoe inner walls, and wherein said flanges promote stabilization and positional self-adjustment of said orthosis inside the footwear and positive foot support while said notch allows a thinner rear portion orthosis configuration.

6. An orthosis formed of a monolithic semi-rigid resilient shell for engagement inside a footwear and for conformingly fitting against the plantar portion of a person's foot, said orthosis adapted to extend from the anterior metatarsal region to the heel portion of a person's foot, said orthosis defining an inner and an outer side and comprising a rear end portion having inner and outer rearwardly-extending resiliently deformable arms defining at their rear ends a rearwardly-opened notch therebetween for partial engagement of the heel in said notch, said rear end portion further having upwardly arcuate inner and outer flanges integrally carried respectively on said inner and outer arms, opposite said notch, for forming a laterally supporting seat for the heel, said orthosis further comprising a front end portion for engaging the metatarsal plantar region of the foot, having a sinuous front edge which includes five frontwardly-facing arcuate concavities each for registering wedging engagement therein by a corresponding one of the five metatarsal anterior portions of that person's foot;

wherein the combination of the independently deformable arms forming said laterally supporting heel seat with said front edge concavities forming metatarsal head seats, allows stabilization and positional self-adjustment of said orthosis inside the footwear to compensate accidental positional shifts of said orthosis in the footwear.

* * * * *